US009630693B2

(12) United States Patent
De Kruijf et al.

(10) Patent No.: US 9,630,693 B2
(45) Date of Patent: Apr. 25, 2017

(54) METHOD OF ARRANGING THE LUBRICATION OF A STEERABLE THRUSTER OF A MARINE VESSEL AND A LUBRICATION ARRANGEMENT THEREFOR

(75) Inventors: Arnoud De Kruijf, Haaren (NL); Rik Roemen, Oisterwijk (NL); Aad Van Der Kam, Drunen (NL); Bart Van Der Ven, Waspik (NL)

(73) Assignee: WARTSILA FINLAND OY, Vaasa (FI)

( * ) Notice: Subject to any disclaimer, the term of this patent is extended or adjusted under 35 U.S.C. 154(b) by 261 days.

(21) Appl. No.: 14/359,239

(22) PCT Filed: Nov. 18, 2011

(86) PCT No.: PCT/FI2011/051015

§ 371 (c)(1),
(2), (4) Date: May 19, 2014

(87) PCT Pub. No.: WO2013/072549

PCT Pub. Date: May 23, 2013

(65) Prior Publication Data

US 2014/0318898 A1 Oct. 30, 2014

(51) Int. Cl.

| | |
|---|---|
| ***B63H 20/00*** | (2006.01) |
| ***B63H 5/125*** | (2006.01) |
| ***B63H 21/38*** | (2006.01) |

(52) U.S. Cl.

CPC ..... *B63H 20/002* (2013.01); *B63H 5/125* (2013.01); *B63H 21/386* (2013.01); *B63H 2005/1256* (2013.01)

(58) Field of Classification Search

CPC .... B63H 20/002; B63H 5/125; B63H 21/286; B63H 2005/1256

(Continued)

(56) References Cited

U.S. PATENT DOCUMENTS 1,822,573 A * 9/1931 Anderson ..... B63H 20/002 123/196 W
2,440,338 A * 4/1948 Kincannon ..... B63H 20/002 123/196 W (Continued)

FOREIGN PATENT DOCUMENTS

GB 1 214 782 A 12/1970
NL 8 005 590 A 5/1982

(Continued)

OTHER PUBLICATIONS

Decision on Grant for Patent Invention, dated Jun. 3, 2015, for corresponding Russian application No. 2014124707/11, filed on Nov. 18, 2011.

(Continued)

*Primary Examiner* — Michael Riegelman
(74) *Attorney, Agent, or Firm* — Heslin Rothenberg Farley & Mesiti P.C.; Victor A. Cardona, Esq.

(57) ABSTRACT

The lubrication of a steerable thruster of a marine vessel is based on splash-type lubrication at the pod and full bath lubrication in the stembox and in the shank. The lubrication oil enters the pod both from the stembox and the shank via a constriction and directly from the oil tank. The oil is further circulated from the pod to the oil tank by means of pumps.

24 Claims, 3 Drawing Sheets

(58) Field of Classification Search
USPC ..... 184/13.1
See application file for complete search history.

(56) References Cited

U.S. PATENT DOCUMENTS

| | | | | | |
|---|---|---|---|---|---|
| 2,496,434 | A * | 2/1950 | Bosma | B63H 20/001 | 123/196 W |
| 2,918,986 | A * | 12/1959 | Leipert | F16N 7/40 | 184/6.18 |
| 3,042,146 | A * | 7/1962 | Shimanckas | B63H 20/002 | 123/196 R |
| 3,647,024 | A * | 3/1972 | Wick | F16N 7/363 | 123/196 W |
| 3,799,291 | A * | 3/1974 | Becker | B63H 20/16 | 184/6.18 |
| 3,931,783 | A * | 1/1976 | Croisant | B63H 20/002 | 123/196 W |
| 4,993,979 | A * | 2/1991 | Bland | B63H 20/002 | 123/196 W |
| 5,035,664 | A * | 7/1991 | Bland | B63H 21/38 | 192/21 |
| 5,643,025 | A * | 7/1997 | Suzuki | B63H 20/002 | 123/196 W |
| 7,182,658 | B2 * | 2/2007 | Asakaze | B63H 21/38 | 440/75 |
| 2006/0175039 | A1 * | 8/2006 | Nagashima | B63H 20/002 | 165/65 |
| 2014/0299030 | A1 * | 10/2014 | De Bruin | B63H 25/22 | 114/150 |
| 2015/0021120 | A1 * | 1/2015 | Burger | B63H 20/002 | 184/14 |

FOREIGN PATENT DOCUMENTS

| | | |
|---|---|---|
| RU | 2172276 C1 | 8/2001 |
| RU | 126319 U1 | 3/2013 |
| RU | 2567491 C1 | 11/2015 |

OTHER PUBLICATIONS

International Search Report for International Application No. PCT/FI2011/051015, dated Jul. 5, 2012.

* cited by examiner

METHOD OF ARRANGING THE LUBRICATION OF A STEERABLE THRUSTER OF A MARINE VESSEL AND A LUBRICATION ARRANGEMENT THEREFOR

CROSS-REFERENCE TO RELATED APPLICATIONS

This application is a 371 National Phase of PCT International Application No. PCT/FI2011/051015 filed on Nov. 18, 2011, and published in English as WO 2013/072549 A1 on May 23, 2013, the entire disclosure of which is incorporated herein by reference.

TECHNICAL FIELD

The present invention relates to a novel method of arranging the lubrication of a steerable thruster of a marine vessel and a lubrication arrangement therefor. The lubrication method and arrangement of the invention are specifically applicable in steerable thrusters used in arctic environment, i.e. in ice infested waters.

BACKGROUND ART

A thruster as here understood is a steerable propulsion device arranged mainly beneath the hull of a marine vessel. The thruster is formed of a propeller unit (rotatable/steerable round a vertical axis) beneath the hull and of a substantially vertical housing. The propeller drive may be arranged mechanically, hydraulically or electrically. Though the present invention covers all three drive options, the following exemplary description of the thruster concentrates on the structures required by the mechanical drive. The electric and hydraulic drives have been only briefly discussed.

The exemplary thruster, when viewed from the standpoint of the mechanical drive has three main parts, i.e. the upper gearbox, the vertical shaft, and the lower gearbox. The upper gearbox includes the upper gear transmission that is formed of a substantially horizontal drive shaft terminating to a pinion wheel, which transmits power to a larger gearwheel mounted on a substantially vertical upper gearbox shaft. The vertical shaft is normally formed of three parts, i.e. the upper gearbox shaft, a floating intermediate shaft, and a pinion wheel shaft. The intermediate shaft may be coupled to the upper gearbox shaft and to the pinion wheel shaft with flexible or floating shaft couplings or the intermediate shaft may be replaced with a flexible or floating shaft coupling. The lower end of the vertical shaft, i.e. the pinion wheel shaft is provided with a pinion wheel that transmits the power to a gearwheel mounted on a substantially horizontal propeller drive shaft. Both the pinion wheel and the gearwheel are located within the lower gearbox. The lower gearbox is also called a pod. In both gearboxes the rotational speed of the shafts receiving the power is reduced.

If the thruster has an electric or hydraulic drive the upper gearbox of the mechanical drive may be replaced with the electric or hydraulic drive. The shaft of the electric or hydraulic drive motor is vertical and connected, preferably by means of a flexible or floating coupling, to the intermediate shaft or directly to the pinion wheel shaft. The electric or hydraulic drive motor may sometimes be provided with a shaft extending down to the pinion wheel to form its shaft, too.

Since the thruster discussed in this specification is a steerable one, the thruster has to be made rotatable round the vertical axis. This means that the upper gearbox has to be kept stationary, while the rest of the thruster components are steered. To fulfil this requirement the upper gearbox is fastened by means of an annular cover plate to the hull structure of the marine vessel. The cover plate has an opening for the vertical shaft, and it is provided with at least one steering motor the shaft of which extends substantially vertically through the cover plate. The lower end of the shaft of the steering motor is provided below the cover plate with a steering gear pinion that rotates a ring-shaped gearwheel arranged on an annular flange mounted on a vertical shaft housing forming the frame structure of the steerable/rotating thruster. The vertical haft housing surrounds the vertical shaft and extends downwardly such that the lower gearbox is fastened to the lower end the vertical shaft housing. The vertical shaft housing is formed of an upper part called as an upper vertical shaft housing, and a lower part called as a lower vertical shaft housing. The upper vertical shaft housing surrounds the floating intermediate shaft, and the lower vertical shaft housing the pinion wheel shaft. The lower face of the cover plate is provided with a ring-shaped support member, the radially outer surface of which faces the radially inner surface of the ring-shaped gearwheel. A bearing supporting the weight of the vertical shaft housing and the lower gearbox is arranged in connection with the ring-shaped support member and the ring-shaped gearwheel. The upper vertical shaft housing is surrounded by a so-called stembox the outer wall (converging conically in FIG. 1) of which is arranged in connection with the hull structures of the marine vessel. The lower end of the stembox outer wall is provided with bearings supporting the vertical shaft housing and with sealings for keeping the lubrication oil within the stembox.

Below the bearings and the sealings the upper vertical shaft housing terminates to a flange to which the lower vertical shaft housing is attached. The lower vertical shaft housing, so-called shank forms a cavity through which the pinion wheel shaft runs and where the upper bearings of the pinion wheel shaft are located. To the lower end of the lower vertical shaft housing is the lower gearbox fastened. The lower gearbox, i.e. the pod is provided with the lower bearings of the pinion wheel shaft, and the propeller drive shaft with its bearings.

The lubrication of the steerable thruster has been arranged this far by either arranging full oil bath in both the stembox, the shank and the lower gearbox or arranging splash lubrication in each lubricating position. However, practice has shown that splash lubrication especially in the stembox is challenging, as part of the points requiring lubrication are at the level of the top of the stembox, i.e. the steering bearing and the gearwheels involved in steering. Thus full bath lubrication in the stembox is the preferred alternative. Though full bath lubrication ensures the best lubrication the practice has shown that full bath lubrication in the lower gearbox wastes substantial amount of energy due to gearwheels churning oil. This problem is especially severe when the thruster is a so-called ice-pod used in arctic environment. The ice-pod construction means, when compared to traditional open water thrusters, a relatively small propeller and a high propeller shaft speed, which results in higher energy consumption in the churning of oil.

BRIEF SUMMARY OF THE INVENTION

A first object of the present invention is to offer a solution to one or more of the above discussed problems.

A second object of the present invention is to suggest an improvement in the lubrication system of a steerable thruster for minimizing the energy consumption of the lubrication system.

A third object of the present invention is to ensure reliable and efficient lubrication of the gearwheels and bearings used for steering the thruster.

A fourth object of the present invention is to utilize splash lubrication at the lower gearbox.

A fifth object of the present invention is to increase the oil circulation for filtering and cooling purposes.

At least one of the above and other objects of the invention are met by a method of arranging the lubrication of a steerable thruster of a marine vessel, the lubrication arrangement having an oil tank and circulation means for circulating oil between the oil tank and the thruster, the thruster comprising a drive means, a lower gearbox, so called pod, and a vertical shaft therebetween, the lower gearbox including a shaft for running a propeller, a gearwheel mounted on the propeller shaft and rotated by means of a pinion wheel having a substantially vertical pinion wheel shaft, the pinion wheel shaft forming at least a part of the vertical shaft, the vertical shaft being surrounded by a vertical shaft housing, the pinion wheel being supported to the vertical shaft housing by means of bearings, the vertical shaft housing being supported rotatably to hull structures of the marine vessel, an oil compartment being arranged in connection with the vertical shaft housing and sealed thereto by a sealing, the method comprising the step of arranging full bath lubrication in the oil compartment and arranging a splash-type lubrication in the pod by regulating the amount of oil introduced into the pod for maintaining a desired oil level $O_L$ in the pod.

At least one of the above and other objects of the invention are met by a lubrication arrangement for a steerable thruster of a marine vessel, the lubrication arrangement having an oil tank and circulation means for circulating oil between the oil tank and the thruster, the thruster comprising a drive means, a lower gearbox, so called pod, and a vertical shaft therebetween, the lower gearbox including a shaft for running a propeller, a gearwheel mounted on the propeller shaft and rotated by means of a pinion wheel having a substantially vertical pinion wheel shaft, the pinion wheel shaft forming at least a part of the vertical shaft, the vertical shaft being surrounded by a vertical shaft housing, the pinion wheel being supported to the vertical shaft housing by means of bearings, the vertical shaft housing being supported rotatably to hull structures of the marine vessel, an oil compartment being arranged in connection with the vertical shaft housing and sealed thereto by a sealing for ensuring full bath lubrication in the oil compartment, the lubrication arrangement comprising means for providing splash-type lubrication in the pod.

Other characteristic features of the present method of arranging the lubrication of a steerable thruster of a marine vessel and a lubrication arrangement therefor will become apparent from the appended dependent claims.

The present invention, when solving at least one of the above-mentioned problems, lowers the energy consumption of the pod, and makes it possible to manage splash lubrication in the pod without any need to monitor the oil level in the pod.

BRIEF DESCRIPTION OF DRAWING

In the following, the novel method of arranging the lubrication of a steerable thruster of a marine vessel and a lubrication arrangement therefor is explained in more detail with reference to the accompanying Figures, of which

DETAILED DESCRIPTION OF DRAWINGS

Figure 1:
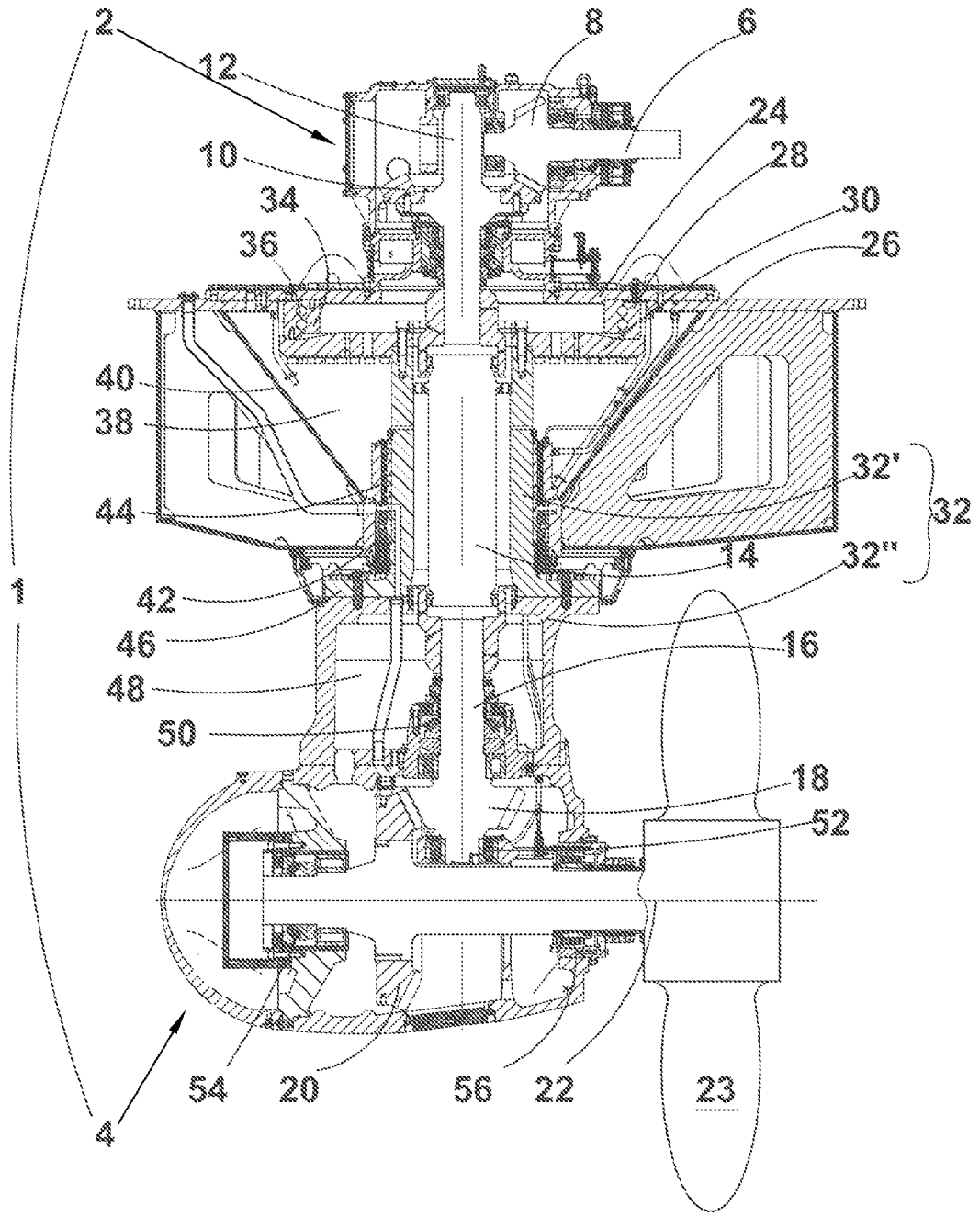
Fig. 1 (Prior Art)
FIG. 1 illustrates schematically an exemplary prior art steerable thruster.

FIG. 1 illustrates a mechanically driven (though also electric or hydraulic drives may be used in connection with thrusters) exemplary prior art steerable thruster 1 that, when viewed from the standpoint of its drive has three main parts, i.e. the upper gearbox 2, the vertical shaft, and the lower gearbox 4. The upper gearbox 2 includes the upper gear transmission that is formed of a substantially horizontal drive shaft 6 terminating to a pinion wheel 8, which transmits power to a larger gearwheel 10 mounted on a substantially vertical upper gearbox shaft 12. The vertical shaft is, in this example, formed of three parts, i.e. the upper gearbox shaft 12, a floating intermediate shaft 14, and a pinion wheel shaft 16. It has to be understood that he intermediate shaft may be coupled to the upper gearbox shaft and to the pinion wheel shaft with flexible or floating shaft couplings or the intermediate shaft may be replaced with a flexible or floating shaft coupling. The lower end of the vertical shaft, i.e. the pinion wheel shaft 16 extends in the lower gearbox 4 and is provided with a pinion wheel 18 that transmits the power to a gearwheel 20 mounted on a substantially horizontal propeller drive shaft 22. Both the pinion wheel 18 and the gearwheel 20 are thus located within the lower gearbox 4. The lower gearbox 4 may also be called a pod. In both gearboxes 2 and 4 the rotational speed of the shafts 12 and 22 receiving the power is reduced.

Figure 3:
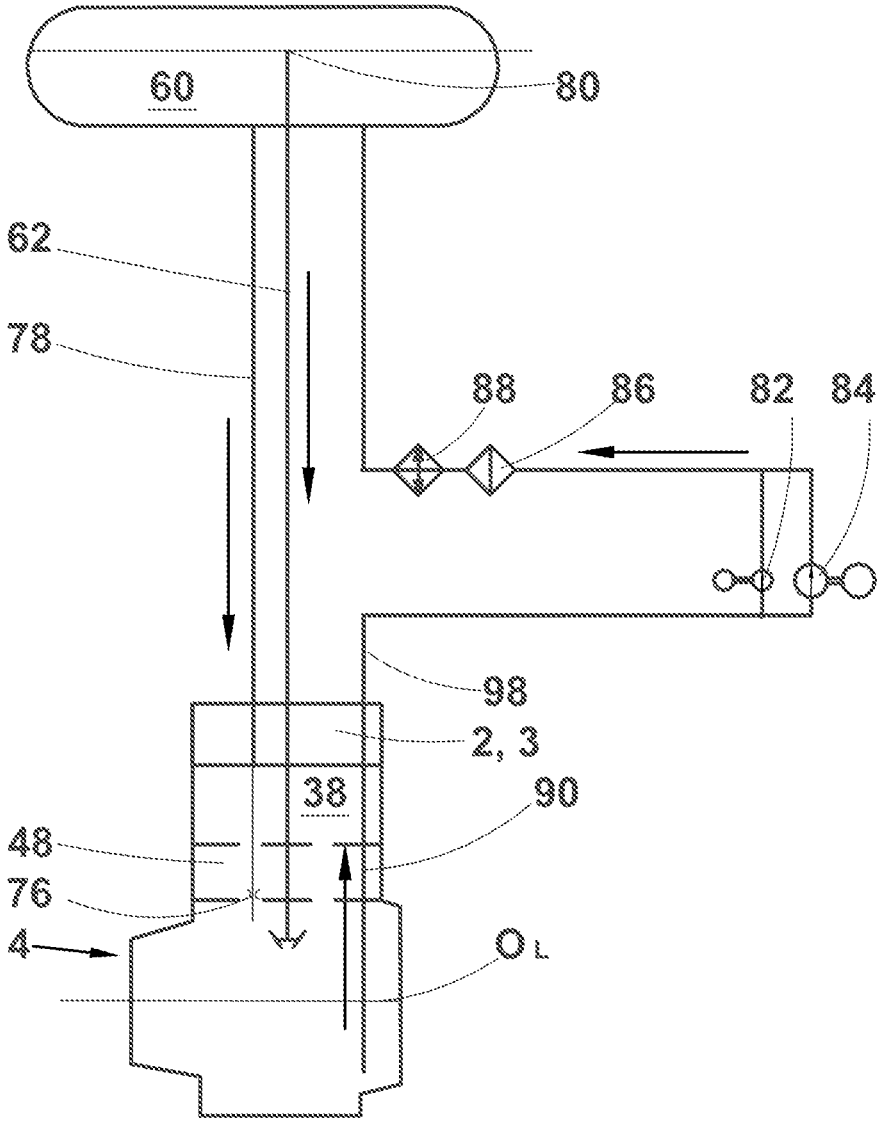
FIG. 3 illustrates schematically the lubrication circuit of the steerable thruster of FIG. 2.

If the thruster has an electric or hydraulic drive the upper gearbox 2 of the mechanical drive may be replaced with the electric or hydraulic drive 3 (see FIG. 3). The shaft of the electric or hydraulic drive motor is vertical and connected, preferably by means of a flexible or floating coupling, to the intermediate shaft 14 or directly to the pinion wheel shaft 16. The electric or hydraulic drive motor may sometimes be provided with a shaft extending down to the pinion wheel 18 to form its shaft, too.

Since the exemplary thruster discussed in this specification is a steerable one, the thruster has to be made rotatable round its vertical axis. This means that the upper gearbox 2 is stationary, while the rest of the thruster components are steerable, i.e. rotatable. To fulfil this requirement the upper gearbox 2 is fastened by means of an annular cover plate 24 to the hull structure 26 of the marine vessel. The cover plate 24 has an opening for the vertical shaft, and it is provided with at least one steering motor (not shown) the shaft of which extends substantially vertically through the cover plate 24. The lower end of the shaft of the steering motor is provided below the cover plate 24 with a steering gear pinion that rotates a ring-shaped gearwheel 28 arranged on an annular flange 30 mounted on a vertical shaft housing 32 forming the frame structure of the steerable/rotating thruster. The vertical shaft housing 32 surrounds the vertical shaft and extends downwardly such that the lower gearbox 4 is fastened to the lower end the vertical shaft housing 32. The vertical shaft housing 32 is formed of an upper part called an upper vertical shaft housing 32', and a lower part called a lower vertical shaft housing 32". The upper vertical shaft housing 32' surrounds the floating intermediate shaft 14 (and its couplings or the coupling replacing the intermediate shaft), and the lower vertical shaft housing 32" the pinion wheel shaft 16. The lower face of the cover plate 24 is provided with a ring-shaped support member 34, the radially outer surface of which faces the radially inner surface of the ring-shaped gearwheel 28. A bearing 36 supporting the weight of the vertical shaft housing 32 and the lower gearbox 4 is arranged in connection with the ring-shaped support member 34 and the ring-shaped gearwheel 28. The upper vertical shaft housing 32' is surrounded by a so-called stembox 38 the outer wall 40 (converging conically in FIG. 1) of which is arranged in connection with the hull structure 26 of the marine vessel. The lower end of the stembox outer wall 40 is provided with bearings 42 supporting the upper vertical shaft housing 32' and with a sealing 44 for keeping the lubrication oil within the stembox 38. The flange 30, the ring-shaped gearwheel 28, and the ring-shaped support member 34 with their bearing 36, and the pinion wheel of the steering motor are all located within the stembox 38.

Below the bearings 42 and the sealing 44 the upper vertical shaft housing 32' terminates to a flange 46 to which the lower vertical shaft housing 32" is attached. The lower vertical shaft housing 32" forms a cavity, so-called shank 48, through which the pinion wheel shaft 16 runs and where the upper bearings 50 of the pinion wheel shaft 16 are located. To the lower end of the lower vertical shaft housing 32" is the lower gearbox 4 fastened. The lower gearbox, i.e. the pod 4, is provided with the lower bearing 52 of the pinion wheel shaft 16, and the propeller drive shaft 22 with its bearings 54 and 56. Here it has to be understood that the pinion wheel shaft 16 may be supported within the shank only, i.e. by means of the bearings 50 only, whereby the lower end of the shaft does not need the bearings 52 shown in the drawings.

The lower gearbox 4 contains the gear transmission 18 and 20 transmitting power from the vertical shaft towards the propeller 23 and the bearings 52 (if used), 54 and 56 supporting the shafts 16 and 22. Some friction is present in both the gears and the bearings. Therefore some form of lubrication and cooling is required. Since the thruster in question may be used in an arctic environment, i.e. in ice-infested conditions a typical aspect of such a specific thruster is a relatively small propeller 23 and a high propeller shaft speed. A consequence of the latter is an increase in the friction related power loss in the lower gearbox. A part of the loss is caused by the churning of the oil by the gearwheel 20 on the propeller shaft 22. The compartments above the lower gearbox, i.e. the shank 48 and the stembox 38, contain the supporting bearings 36 for the rotating vertical shaft housing 32, the gear tooth connections of the vertical shaft parts, the bearings 50 on the pinion shaft 16 and the centre joint sealing 44. All these components require lubrication for ensuring their reliable operation. The upper bearings 50 on the pinion shaft 16 also require some cooling during operation to compensate for the friction heat generated within the bearings 50.

In prior art thrusters illustrated in FIG. 1 the pod 4, the shank 48 and the stembox 38 formed one volume, which was filled with oil. The oil was sucked up and out of the thruster from the bottom of the pod 4. The oil sucked out of the pod 4 was pumped through a set of coolers and filters to a header tank. The oil was returned to the thruster from the header tank by introducing it at the top of the stembox 38. The whole system was pressurized by means of placing the header tank at a certain distance above the thruster.

Figure 2:
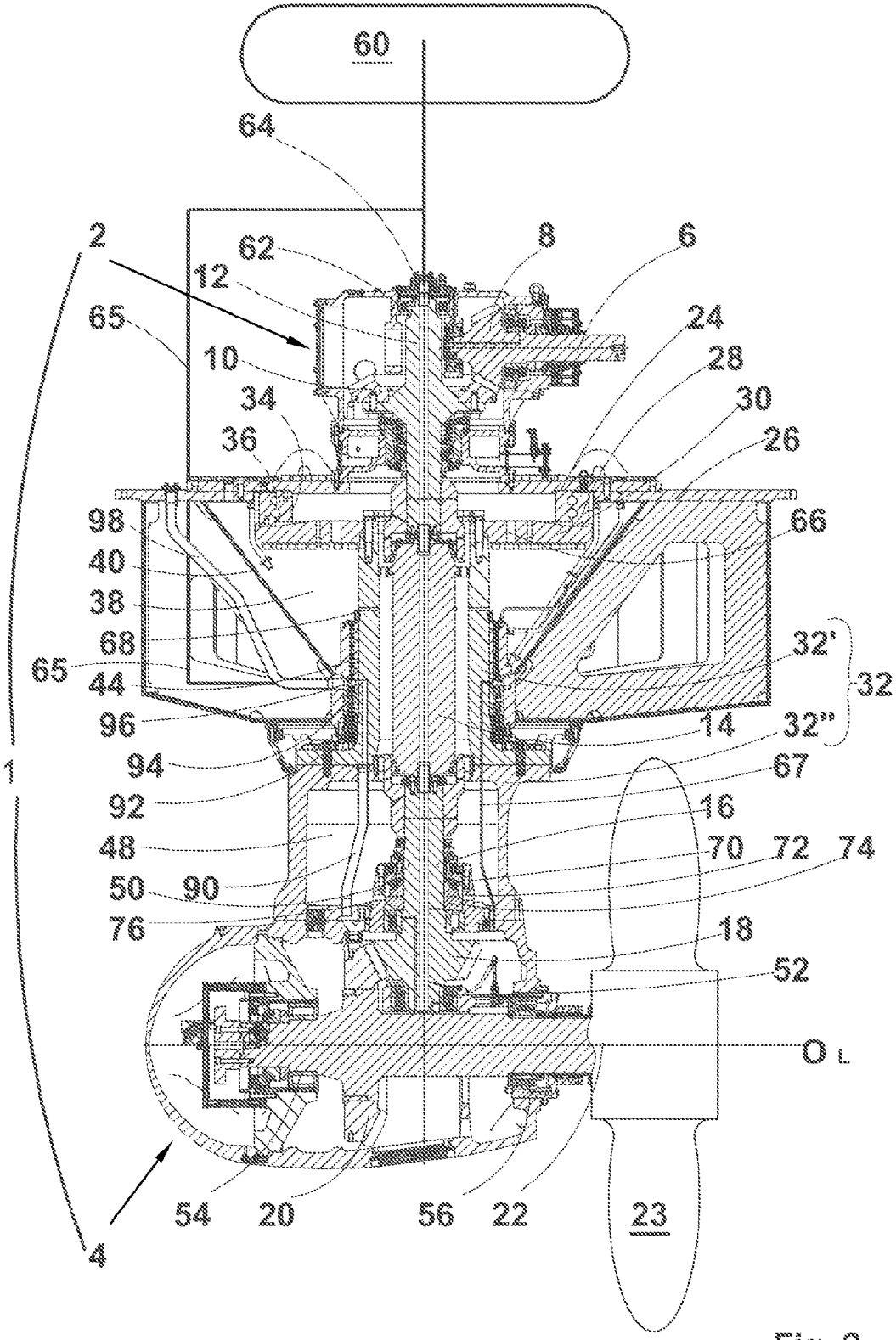
FIG. 2 illustrates schematically a steerable thruster in accordance with a preferred embodiment of the present invention.

FIG. 2 illustrates the thruster in accordance with the present invention. The basic structure of the thruster is similar to that shown in FIG. 1. Thus the same components are referred to by the same reference numerals. To solve at least some of the above discussed problems the lower gearbox 4 is provided with a splash-type lubrication, whereas the stembox 38 and the shank 48 have full-bath lubrication. However, even with the application of the splash lubrication in the pod the friction losses within the lower gearbox 4 are still considerable. To ensure that the temperature of the oil within the pod does not reach an unacceptable high value the oil has to be cooled. This requires a continuous circulation of the oil from the lower gearbox 4 to an oil cooler arranged in the oil circulation between the pod 4 and the oil tank 60. The oil level needs to be maintained at the gearwheel centre while the oil is circulated. The structural improvements solving above discussed problems relate to an oil passage directly from the oil tank 60 to the lower gearbox 4, i.e. to the pod, an overflow in the oil tank 60 and the constriction or restriction arranged at the oil flow path between the shank 48 and the pod 4.

The oil passage running directly from the oil tank 60 to the lower gearbox 4, the pod, may be arranged, in accordance with a preferred embodiment of the present invention, by arranging a bore 62 along the entire length of the vertical shaft, i.e. in the structural embodiment shown in the drawings the bore 62 is arranged in each part of the vertical shaft, i.e. in the upper gearbox shaft 12, in the intermediate shaft 14 and in the pinion wheel shaft 16. Additionally, a rotary pipe coupling 64 has been arranged at the upper end of the upper gearbox shaft 12 and couplings between the parts of the vertical shaft so that oil may flow down to the pinion wheel shaft 16 and further in the pod 4. Another option (FIG. 2) is to arrange an oil pipe 65 either in the stembox 38 or outside the stembox for taking oil from the oil tank 60 to the sealing/bearing housing at the lower end of the stembox. The connection from stationary hull structures to the rotary vertical shaft housing is easy to arrange via the sealing. Here, the oil may be taken to an annular channel that is by means of a radial conduit in flow communication with a substantially vertical conduit in the vertical shaft housing taking oil down to the shank. In the shank a pipe 67 running through the shank 48 down to the pod may be arranged for taking oil further down to the pod.

In case the thruster has an electric or hydraulic drive both above discussed ways of providing oil from the oil tank to the pod may be used. In other words, an axial bore may be arranged along the shaft of the electric or hydraulic drive motor, or an external oil passage as discussed above may also be used.

In addition to a passage taking oil from the oil tank 60 to the pod 4, the pod 4 has to be provided with a ventilation conduit. Such a conduit is preferably, but not necessarily, arranged between the pod 4 and the oil tank 60. The ventilation conduit may, in principle, run along with the above discussed oil pipe (for example, at a side thereof) as a separate conduit, or the oil pipe, including both the above-discussed pipeline 65 and 67 and the bore 62 in the vertical shaft, may be dimensioned such that the oil flowing downwardly never fills the pipe/bore, but leaves enough room for the air to escape from the pod 4 up to the oil tank 60.

The oil circulation, for instance for the purpose of filtering and/or cooling of the oil, from the stembox 38 and the shank 48 is arranged to take place via the lower gearbox 4. In other words, the oil that lubricates the steering gear pinion, its gearwheel 24 and the support bearing 36 below the cover plate 24 has direct access between the intermediate shaft 14 and the upper vertical shaft housing 32' to the shank 48. The same oil has also access via openings 66 through the flange 30 into the stembox 38 for lubricating the sealing 44 at the bottom of the stembox 38 between the stationary hull structures 26 (including the stembox wall 40) and the rotary upper vertical shaft housing 32'. The stembox 38 is in communication with the shank 48 by means of holes 68 in the upper vertical shaft housing 32' for allowing oil flow from the stembox 38 to between the intermediate shaft 14 and the upper vertical shaft housing 32'. Thus the stembox 38 and the shank 48 form, in practice, the same oil compartment.

The oil circulation out of this compartment is adjusted by means of a constriction or a restriction arranged between the shank 48 and the lower gearbox 4. There are at least two options for arranging the constriction. A first option (not shown in the drawings) is a hole having a desired diameter, the hole being arranged through the parts of the lower vertical shaft housing and of the pod used for fastening the two components together. A second option, shown in FIG. 2, is to arrange the oil flow from the shank 48 to the pod 4 via the upper bearings 50 of the pinion shaft 16. It has been arranged by providing the bearing housing 70 with at least one hole 72 bringing oil into the bearing housing, in this exemplary embodiment between the upper pair of tapered roller bearings and the lower roller bearing. To be more precise, the oil is brought above an intermediate ring 74 between the two sets of bearings. Thus the upper pinion shaft bearings 50 are lubricated and cooled with a controlled oil flow from the shank 48 towards the pod 4. The constriction 76 is arranged between the rotary intermediate ring 74 and the inner surface of the bearing housing 70. In other words, there is a small gap between these two members.

In operation a small amount of oil flows from the oil tank 60 to the stembox 38, the shank 48 and finally into the lower gearbox or pod 4. Naturally, the viscosity (or the temperature) of the oil has a marked effect on the amount of oil leaking from the shank 48 to the pod 4. Thus, when the oil is cool and need not be cooled, the oil flow from the shank to the pod is smaller, and when the oil is hot requiring cooling the flow is higher. By means of the above described construction it is ensured that the oil flow through the bearings 50 takes away the heat generated by friction in the bearings. The flow also enables circulation and filtration of the oil going through the stembox 38 and the shank 48. In normal conditions and in accordance with an advantageous embodiment of the present invention the thruster lubrication circuit is designed such that about one third of the circulating oil comes from the shank 38 to the pod 4 and two thirds directly from the oil tank 60.

To make sure the oil flows from the shank 48 towards the lower gearbox 4, the pressure within the shank 48 needs to be higher than that within the lower gearbox 4. This is arranged with the combination of the direct connection 62 from the oil tank 60 to the pod 4, the constriction 76 and the ventilation of the oil tank 60. The direct oil flow from the oil tank 60 is arranged by placing the oil exit opening in the pod 4 above the oil level $O_L$ in the lower gearbox 4, and, in accordance with a preferred alternative, arranging the bore 62 along the vertical shaft so wide that oil flows along the bore inner surface leaving an open center for the ventilation. Naturally, if the pod ventilation has been arranged in some other manner, the bore 62 may be filled with oil. The pressure within the lower gearbox 4 is, as a consequence, equal to the pressure within the oil tank 60. The pressure in the shank 48 is equal to the pressure within the oil tank 60 plus the additional pressure corresponding to the height of the oil from the bottom of the shank 48 up to the oil level in the oil tank 60, i.e. the hydrostatic pressure. As a consequence, the pressure within the shank 48 will always be higher than that in the pod 4 and the oil will flow from the shank 4 to the pod 4.

To make the splash lubrication in the lower gearbox 4 work, the oil level $O_L$ is to be maintained substantially at the centre of the gear wheel 20, i.e. at the level of the axis of the propeller shaft 22. The oil level in the lower gearbox 4 is controlled by regulating the oil level in the oil tank 60. The principle of the level control system is based on an invariable amount of oil in the system. As a consequence the amount of oil in the lower gearbox 4, indicated with $O_L$, is the total amount of oil in the system minus the amount of oil within the shank 48, the stembox 38 and the oil tank 60. The shank 48 and the stembox 38 are both completely filled with oil.

As discussed briefly already above, the problem concerning the power consumption based on the oil churning in the lower gearbox is solved by arranging splash-type lubrication in the pod. The oil level in the pod is not necessarily monitored at all, but the oil circulation has been designed such that it maintains correct oil level in the pod 4. This has been explained in more detail in connection with FIG. 3.

FIG. 3 illustrates schematically the lubrication arrangement of the thruster in accordance with the present invention. The oil is stored in an oil tank 60 above the thruster level from which the oil enters the thruster via two paths. The first path 78 leads from the bottom of the oil tank 60 to the stembox 38 and from there through the shank 48, and the constriction 76 to the pod 4 in the manner discussed in detail in FIG. 2. The second path 62 leads directly from the tank overflow 80 to the pod 4. The tank overflow 80 means in practice that the inlet opening at the upper end of the second path 62 is arranged at a distance above the bottom of the oil tank 60, preferably at about half the height of the oil tank 60. Preferably, but not necessarily, the second path 62 runs axially along the vertical shaft from top of the upper gearbox 2 down to the pod 4, i.e. to the pinion wheel shaft 16, as also explained in detail in FIG. 2. The lubrication oil is recirculated from the pod 4 to the oil tank 60 by means of two oil pumps 82 and 84, though the circulation could be managed with only one pump, too. The return path may, if desired, also comprise an oil filter 86 and/or an oil cooler 88 arranged preferably between the pump/s 82, 84 and the oil tank 60. In accordance with a preferred alternative (See also FIG. 2) the recirculation oil is taken from the bottom area of the pod 4 to a suction channel running as an oil pipe 90 through the shank 48 to a bore 92 in the upper vertical shaft housing 32', and further to a radial bore 94 in the upper vertical shaft housing 32' to reach an annular cavity 96 within the sealing 44 on the outer surface of the upper vertical shaft housing 32'. The annular cavity 96 is in flow communication with a further suction channel 98 (FIG. 2) arranged within the stembox 38 or outside thereof. This suction channel 98 terminates to the pump/s 82, 86 positioned above the pod 4.

The above discussed oil circulation functions as follows. To regulate the oil level in the oil tank 60 the amount of oil in the oil tank 60 is defined. The total amount of oil in the lubrication system is also defined at the start. It is considered to be constant, as no leaking sealings are allowed. As a consequence the amount of oil in the lower gearbox 5 is the total amount of oil minus the amount of oil within the shank 48 and the stembox 38 and in the oil tank 60. Thus by regulating the oil level in the oil tank, the level within the lower gearbox 4 is controlled.

The regulation of the oil level within the oil tank 60 is performed by means of an overflow 80 and the set of pumps 82 and 84. The overflow 80 is an inlet opening at the upper end of the oil path 62 some distance above the bottom of the oil tank 60. The opening is connected to the lower gearbox 4 by means of the oil path 62, the path preferably running along the vertical shaft and terminating to the pinion wheel shaft 16. The oil from the lower gearbox 4 is pumped back into the oil tank by the pumps 82 ad 84.

The regulation of the oil level $O_L$ within the lower gearbox 4 by means of the pumps 82 and 84 and the overflow 80 is discussed in detail by way of the following example. The oil level in the tank 60 is only able to rise to the level of the overflow/opening 80. The amount of oil within the lower gearbox 4 may as a result not become less then the total amount of oil minus the oil in the shank 48, the stembox 38 and the oil tank 60. If the oil level in the oil tank 60 is below the level of the overflow/opening 80, no oil will flow back to the pod 4. The pumps 82 and 84 still transfer oil to the tank 60. The oil level in the tank 60 will rise. The level in the pod 4 will drop. This continues until the level in the tank 60 reaches the overflow/opening 80 again. A return flow of oil will then start from the tank 60 to the pod 4 again. The oil flows towards and out of the pod 4 are in equilibrium again. The level in the oil tank 60 is then again defined by the position of the overflow/opening 80. The amount of oil in the pod 4 is, as a result, also determined.

In case two pumps 82 and 84 are used, the pump 82 may be a smaller one. The smaller pump 82 is intended to be used during start up for sucking oil out of the pod 4. At start-up the oil is still cold and the viscosity is high. Thus the oil circulation from the stembox 38 and the shank 48 to the pod 4 is minimal, if any. As a result only a small oil flow needs to be sucked out of the pod 4. During operation the temperature of the oil increases and the viscosity decreases, whereby more and more oil enters the pod 4 from the shank 48. At a predefined oil temperature the second, larger, pump 84 is switched on. The two pumps 82 and 84 provide in combination the required oil flow to enable sufficient cooling.

It should be understood that the above is only an exemplary description of a novel and inventive method of lubricating a thruster of a marine vessel and a lubrication arrangement therefor. It should be understood that the above description discusses only a few preferred embodiments of the present invention without any purpose to limit the invention to the discussed embodiments and their details only. Thus the above specification should not be understood as limiting the invention by any means but the entire scope of the invention is defined by the appended claims only. From the above description it should be understood that separate features of the invention may be used in connection with other separate features even if such a combination has not been specifically discussed in the description or shown in the drawings.

The invention claimed is:

1. A method of arranging the lubrication of a steerable thruster of a marine vessel, the lubrication arrangement having an oil tank and circulation means for circulating oil between the oil tank and the thruster, the thruster comprising i. drive means, ii. steering means provided within a stembox, 1. the stembox being arranged in connection with hull structures of the marine vessel, iii. a lower gearbox, and iv. a vertical shaft between the drive means and the lower gearbox, the vertical shaft being surrounded by a vertical shaft housing, i. the vertical shaft housing comprising an upper vertical shaft housing and a lower vertical shaft housing, ii. the upper vertical shaft housing being supported rotatably to the hull structures of the marine vessel by being fastened at an upper end thereof to the steering means, iii. the upper vertical shaft housing being fastened at a lower end thereof to the lower vertical shaft housing forming a shank, iv. the lower gearbox being fastened to a lower end of the lower vertical shaft housing, the lower gearbox including a shaft for running a propeller, a gearwheel mounted on the propeller shaft and rotated by means of a pinion wheel having a substantially vertical pinion wheel shaft, the pinion wheel shaft being arranged within the shank and forming at least a part of the vertical shaft, the pinion wheel shaft being supported rotatably to the lower vertical shaft housing by means of bearings, the method comprising:

arranging full bath lubrication in both the stembox and the shank, providing at least two oil paths for introducing oil from the oil tank to the thruster, a first path leading from the oil tank to the lower gearbox via the shank and a second path leading directly from the tank to the lower gearbox, arranging a splash-type lubrication in the lower gearbox by regulating the amount of oil introduced into the lower gearbox for maintaining a desired oil level $O_L$ in the lower gearbox by:

providing the lower gearbox with a controlled amount of lubrication oil from the oil tank, limiting oil flow from the shank to the lower gearbox through a constriction therebetween and circulating a limited amount of oil from the shank to the lower gearbox.

2. The method as recited in claim 1, further comprising maintaining oil level in the oil tank substantially constant for maintaining a desired oil level $O_L$ in the lower gearbox.

3. The method as recited in claim 1, further comprising performing the regulation by arranging an overflow in the oil tank and connecting the second oil path to the overflow.

4. A marine vessel comprising:

a steerable thruster having a lubrication arrangement, the lubrication arrangement having an oil tank and circulation means for circulating oil between the oil tank and the thruster, the thruster comprising drive means, steering means, a lower gearbox, and a vertical shaft between the drive means and the lower gearbox, the steering means being provided within a stembox, the stembox being arranged in connection with hull structures of the marine vessel, the vertical shaft being surrounded by a vertical shaft housing, the vertical shaft housing comprising an upper vertical shaft housing and a lower vertical shaft housing, the upper vertical shaft housing being supported rotatably to the hull structures of the marine vessel by being fastened at an upper end thereof to the steering means, the upper vertical shaft housing being fastened at a lower end thereof to the lower vertical shaft housing forming a shank, the lower gearbox being fastened to the lower end of the lower vertical shaft housing, the lower gearbox including a shaft for running a propeller, a gearwheel mounted on the propeller shaft and rotated by means of a pinion wheel having a substantially vertical pinion wheel shaft, the pinion wheel shaft being arranged within the shank and forming at least a part of the vertical shaft, the pinion wheel shaft being supported rotatably to the lower vertical shaft housing by means of bearings, means for providing splash-type lubrication in the lower gearbox and full bath lubrication in the shank, the means comprising at least two oil paths for introducing oil from the oil tank to the thruster, a first oil path leading from the oil tank to the lower gearbox via the shank, the first oil path having a constriction between the shank and the lower gearbox for limiting oil flow from the shank to the lower gearbox, and a second oil path leading directly from the tank to the lower gearbox.

5. The marine vessel as recited in claim 4, wherein the oil tank has an overflow arranged at an upper end of the second oil path.

6. The marine vessel as recited in claim 4, wherein the constriction is arranged in connection with the bearings of the pinion wheel shaft.

7. The marine vessel as recited in claim 4, wherein the constriction is arranged in the parts joining the lower vertical shaft housing to the lower gearbox.

8. The marine vessel as recited in claim 4, wherein the second oil path is a bore along the vertical shaft.

9. The marine vessel as recited in claim 4, wherein the second oil path is a channel arranged separately from the oil tank via hull structures and vertical shaft housing to the lower gearbox.

10. The marine vessel as recited in claim 4, wherein the lower gearbox is provided with ventilation means.

11. The marine vessel as recited in claim 10, wherein the second oil path is utilized as the ventilation means.

12. The marine vessel as recited in claim 4, wherein the drive means is an upper gearbox, an electric drive or a hydraulic drive.

13. A method of arranging the lubrication of a steerable thruster of a marine vessel, the lubrication arrangement having an oil tank and circulation means for circulating oil between the oil tank and the thruster, the thruster comprising drive means, steering means, a lower gearbox, and a vertical shaft between the drive means and the lower gearbox, the vertical shaft being surrounded by a vertical shaft housing, i. the vertical shaft housing comprising an upper vertical shaft housing and a lower vertical shaft housing, ii. the upper vertical shaft housing being supported rotatably to the hull structures of the marine vessel by being fastened at an upper end thereof to the steering means, a stembox surrounding the upper vertical shaft housing, iii. the upper vertical shaft housing being fastened at a lower end thereof to the lower vertical shaft housing forming a shank, iv. the lower gearbox being fastened to the lower end of the lower vertical shaft housing, the method comprising:

arranging full bath lubrication in both the stembox and the shank, providing at least two oil paths for introducing oil from the oil tank to the thruster, a first path leading from the oil tank to the lower gearbox via the shank and a second path leading directly from the tank to the lower gearbox, arranging a splash-type lubrication in the lower gearbox by regulating the amount of oil introduced into the lower gearbox for maintaining a desired oil level $O_L$ in the lower gearbox providing the lower gearbox with a controlled amount of lubrication oil from the oil tank, limiting oil flow from the shank to the lower gearbox through a constriction therebetween and circulating a limited amount of oil from the shank to the lower gearbox.

14. The method as recited in claim 13, further comprising maintaining oil level in the oil tank substantially constant for maintaining a desired oil level $O_L$ in the lower gearbox.

15. The method as recited in claim 13, further comprising performing the regulation by arranging an overflow in the oil tank and connecting the second oil path to the overflow.

16. A marine vessel comprising:

a steerable thruster having a lubrication arrangement, the lubrication arrangement having an oil tank and circulation means for circulating oil between the oil tank and the thruster, the thruster comprising drive means, steering means, a lower gearbox, and a vertical shaft between the drive means and the lower gearbox, the vertical shaft being surrounded by a vertical shaft housing, the vertical shaft housing comprising an upper vertical shaft housing and a lower vertical shaft housing, the upper vertical shaft housing being supported rotatably to the hull structures of the marine vessel by being fastened at an upper end thereof to the steering means, a stembox surrounding the upper vertical shaft housing, the upper vertical shaft housing being fastened at a lower end thererof to the lower vertical shaft housing forming a shank, the lower gearbox being fastened to the lower end of the lower vertical shaft housing, means for providing splash-type lubrication in the lower gearbox and full bath lubrication in the shank, the means comprising at least two oil paths for introducing oil from the oil tank to the thruster, a first oil path leading from the oil tank to the lower gearbox via the shank, the first oil path having a constriction between the shank and the lower gearbox for limiting oil flow from the shank to the lower gearbox, and a second oil path leading directly from the tank to the lower gearbox.

17. The marine vessel as recited in claim 16, wherein the oil tank has an overflow arranged at an upper end of the second oil path.

18. The marine vessel as recited in claim 16, wherein the constriction is arranged in connection with the bearings of the pinion wheel shaft.

19. The marine vessel as recited in claim 16, wherein the constriction is arranged in the parts joining the lower vertical shaft housing to the lower gearbox.

20. The marine vessel as recited in claim 16, wherein the second oil path is a bore along the vertical shaft.

21. The marine vessel as recited in claim 16, wherein the second oil path is a channel arranged separately from the oil tank via hull structures and vertical shaft housing to the lower gearbox.

22. The marine vessel as recited in claim 16, wherein the lower gearbox is provided with ventilation means.

23. The marine vessel as recited in claim 22, wherein the second oil path is utilized as the ventilation means.

24. The marine vessel as recited in claim 16, wherein the drive means is an upper gearbox, an electric drive or a hydraulic drive.

* * * * *